US007928824B2

(12) United States Patent
Jow et al.

(10) Patent No.: US 7,928,824 B2
(45) Date of Patent: Apr. 19, 2011

(54) INDUCTOR DEVICES

(75) Inventors: Uei-Ming Jow, Taichung (TW); Chang-Sheng Chen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 611 days.

(21) Appl. No.: 12/022,967

(22) Filed: Jan. 30, 2008

(65) Prior Publication Data

US 2008/0231402 A1 Sep. 25, 2008

(30) Foreign Application Priority Data

Mar. 22, 2007 (TW) ..... 96109869 A

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS

| | | | | |
|---|---|---|---|---|
| 6,249,206 | B1 * | 6/2001 | Uchikoba et al. | 336/200 |
| 6,509,821 | B2 | 1/2003 | Oldfield | |
| 6,803,848 | B2 * | 10/2004 | Yeo et al. | 336/200 |
| 7,423,884 | B2 * | 9/2008 | Enchi et al. | 361/761 |
| 2003/0179067 | A1 * | 9/2003 | Gamou et al. | 336/223 |
| 2005/0052268 | A1 * | 3/2005 | Pleskach et al. | 336/200 |
| 2005/0122199 | A1 * | 6/2005 | Ahn et al. | 336/200 |
| 2007/0085649 | A1 * | 4/2007 | Park | 336/200 |
| 2009/0153282 | A1 * | 6/2009 | Taoka et al. | 336/200 |

FOREIGN PATENT DOCUMENTS

| | | | |
|---|---|---|---|
| CN | 1469400 | A | 1/2004 |
| CN | 2768205 | Y | 3/2006 |

* cited by examiner

*Primary Examiner* — Anh T Mai

(57) ABSTRACT

The invention relates to a high frequency inductor device with high quality factor (Q). The inductor device comprises a substrate and a gradually sized conductive coil with a plurality of windings surrounded and disposed on the substrate. The windings comprises a first conductive segment disposed on a first surface of the substrate, a second conductive segment disposed on a second surface of the substrate, a first conductive via hole connecting the first and second conductive segments, and a second conductive via hole connecting the second conductive segment to a first conductive segment of the following winding. The length of the first conductive segment is different than that of the first conductive segment of the following winding.

35 Claims, 21 Drawing Sheets

INDUCTOR DEVICES

BACKGROUND OF THE INVENTION

1. Field of the Invention

The invention relates to inductor devices, and in particular to high frequency integrated inductor devices with high quality factor.

2. Description of the Related Art

Both passive and active electronic devices in electronic circuits have been developed towards technique regimes such as high frequency, broad band, and miniaturization, and are applicable to a variety of electronic and communication devices including telecommunication, digital computer, portable and household appliance. The embedization of passive and active electronic devices has become one of the main developing trends to shrink electronic circuit area. More particularly, embedded passive devices such as embedded inductors have been replacing conventional surface mounted technique (SMT) passive devices.

Relatively more fabrication steps and materials however, are needed for embedding of passive devices into a substrate. In addition, some parasitic effects are generated due to embedding of inductor devices, reducing electrical performance. For example, when conventional inductor devices are embedded into a substrate, both inductance and quality factor of the inductor device are reduced due to substrate loss. Thus, embedded inductor devices with higher inductance and quality factor are needed to meet the requirements of a state of the art electronic circuit. Conventionally, the three characteristics of importance for an inductor device comprise inductance, quality factor and self-resonance frequency (SRF).

Conventional embedded inductor devices are limited by the substrate and have greater parasitic capacitor effect affecting quality factor and SRF. Specifically, a conventional solenoid inductor winds through the substrate generating parasitic capacitor effect, thus limiting applications to lower quality factor applications. Moreover, parasitic capacitor effect can further reduce SRF, limiting the frequency and other potential applications.

Conventional solenoid inductor devices comprise conductive coils with constant length and width, thereby generating parasitic capacitor effect. Inductance, quality factor and SRF of the constant solenoid inductor device are degraded due to parasitic capacitor effect. Therefore, a gradually sized solenoid inductor device is needed to constrain parasitic capacitor effect, thus broadening SRF range and enhancing inductance and quality factor of the inductor device.

Referring to FIG. 1, a schematic view of a conventional solenoid inductor device, a solenoid inductor device 10 comprises a solenoid coil 20 spirally winding a tetragonal core 15. The tetragonal core 15 comprises air or magnetic materials. The inductance of an ideal solenoid inductor device can be calculated by the following equation:

$$L = \mu \frac{N^2 Ac}{lc}$$

where L denotes the inductance of the ideal solenoid inductor device, N denotes the number of winds of the solenoid coil, Ac denotes the area of the solenoid coil, and lc denotes the length of the solenoid coil. The inductance of the ideal solenoid inductor device is proportional to the product of the square of the number of winds N by area of the solenoid coil.

A conventional embedded solenoid inductor device is different from the ideal solenoid inductor device in that coupling occurs between the substrate and the solenoid coil, and between adjacent windings of the solenoid coil, thereby generating parasitic capacitor effect. As the applied frequency is increased, the parasitic capacitor effect becomes more prevalent and reducing SRF.

U.S. Pat. No. 6,509,821, the entirety of which is hereby incorporated by reference discloses an inductor device comprising a coil with tapered windings. Metal wires may be used for gradual winding. However, the conventional gradually winded inductor device is difficult to integrate into a substrate structure. The width of the winding must remain constant, thereby placing a constraint on the quality factor of the inductor device.

Referring to FIG. 2, a schematic view of a conventional embedded solenoid inductor device, a conventional embedded solenoid inductor device 30 comprises a substrate 31 and a conductive coil 40 with a plurality of windings surrounded and disposed on the substrate 31. A winding comprises a first conductive segment 33 disposed on a first surface of the substrate 31. A second conductive segment 32 is disposed on a second surface of the substrate 31. A first conductive via hole 34 perforating the substrate 31 connects the first conductive segment 33 and the second conductive segment 35. A second conductive via hole 36 perforating the substrate 31 connects the second conductive segment 35 to a first conductive segment of the following winding. The conventional embedded solenoid inductor device 30 comprises uniform length and width windings. Specifically, both the length and width of all the first conductive segments are equal throughout windings. The conductive coil 40 further comprises an input end 32 and an output end 37. The input end 32 is connected to the first conductive segment 33 at the start of the windings. The output end 37 is connected to the second conductive segment at the end of the winding.

A need exists for an embedded solenoid inductor device for high frequency application which constrains parasitic capacitor effect, thus broadening application frequency range while enhancing inductance and quality factor.

BRIEF SUMMARY OF THE INVENTION

The invention relates to embedded inductor devices with gradually sized solenoid coils to enhance high inductance, self-resonate frequency (SRF), and quality factor at high frequency application. Specifically, by designing gradually sized solenoid coil length and width, a horn shaped solenoid coil is embedded in a substrate to increase SRF and improve performance of the embedded inductor device in the electronic circuit.

The invention provides an embedded inductor device, comprising a substrate and a gradually sized conductive coil with a plurality of windings surrounded and disposed on the substrate. A winding comprises a first conductive segment disposed on a first surface of the substrate. A second conductive segment is disposed on a second surface of the substrate. A first conductive via hole connects the first and second conductive segments. A second conductive via hole connects the second conductive segment to a first conductive segment of the following winding, wherein the length of the first conductive segment is lesser than that of the first conductive segment of the following winding.

The invention further provides an embedded inductor device, comprising a substrate and a gradually sized conductive coil with a plurality of windings surrounded and disposed on the substrate. A winding comprises a first conductive segment disposed on a first surface of the substrate. A second conductive segment is disposed on a second surface of the substrate. A first conductive via hole connects the first conductive segment and second conductive segment. A second conductive via hole connects the second conductive segment to a first conductive segment of the following winding, wherein the length of the first conductive segment is less than that of the first conductive segment of the following winding, and wherein the width of the first conductive segment is less than that of the first conductive segment of the following winding.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

A detailed description is given in the following embodiments with reference to the accompanying drawings.

The following description is of the best-contemplated mode of carrying out the invention. This description is made for the purpose of illustrating the general principles of the invention and should not be taken in a limiting sense. The scope of the invention is best determined by reference to the appended claims.

The invention relates to embedded inductor devices with horn shaped solenoid coils to enhance high inductance, self-resonate frequency (SRF), and quality factor for high frequency application, and improve performance of the embedded inductor device in the electronic circuit.

Figure 1:
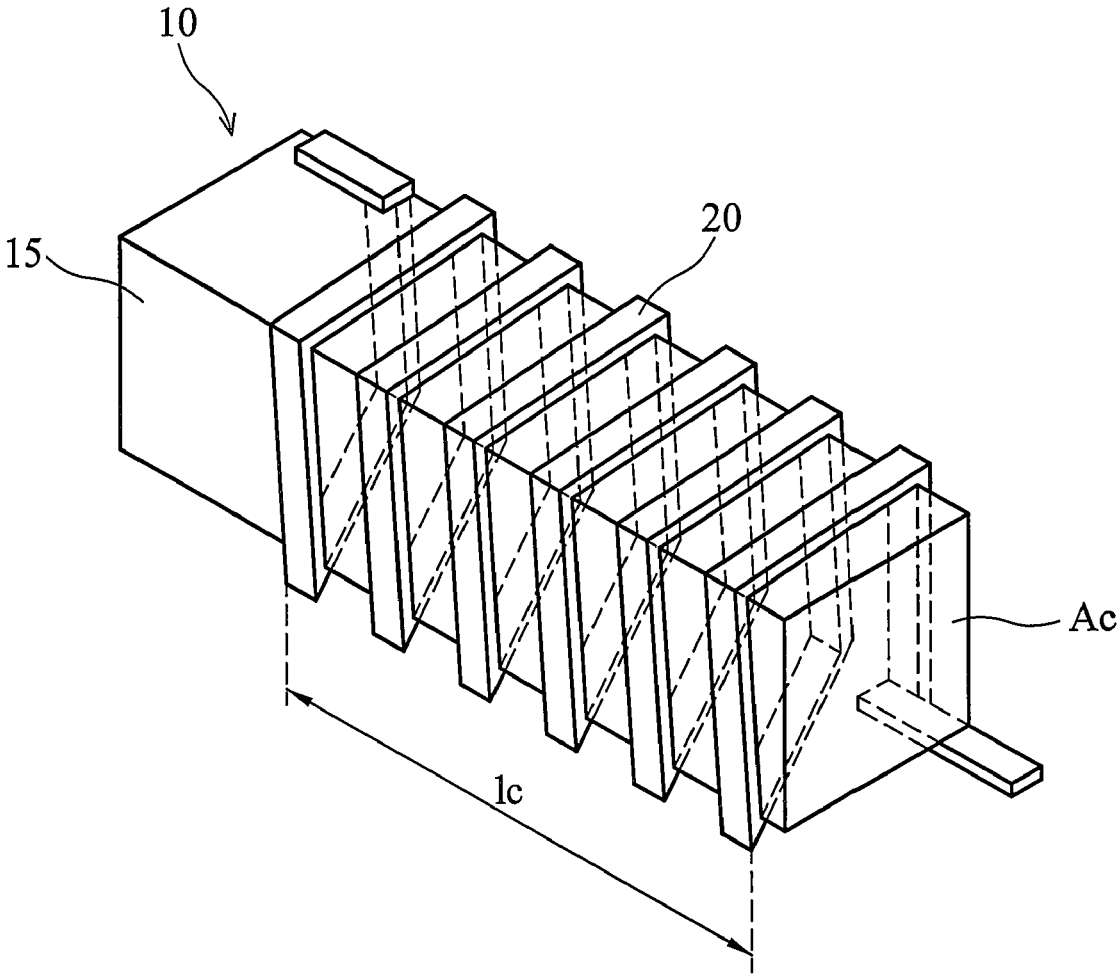
FIG. 1 (PRIOR ART)
FIG. 1 is a schematic view of a conventional solenoid inductor device.
Figure 2:
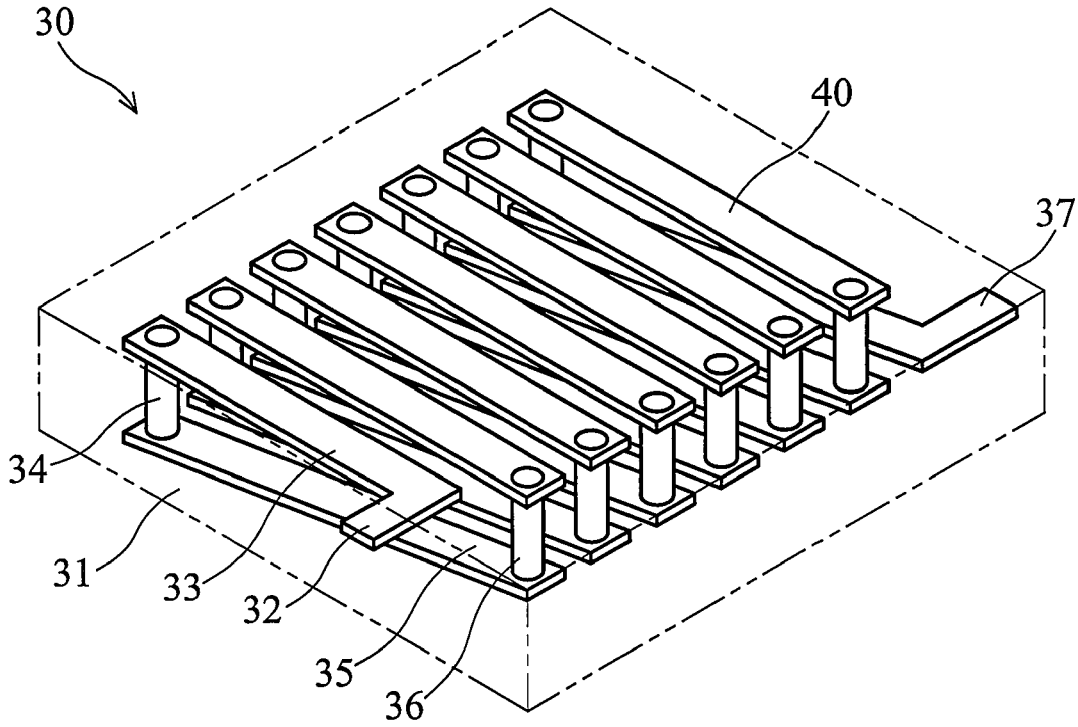
FIG. 2 (PRIOR ART)
FIG. 2 is a schematic view of a conventional embedded solenoid inductor device.
Figure 3A:
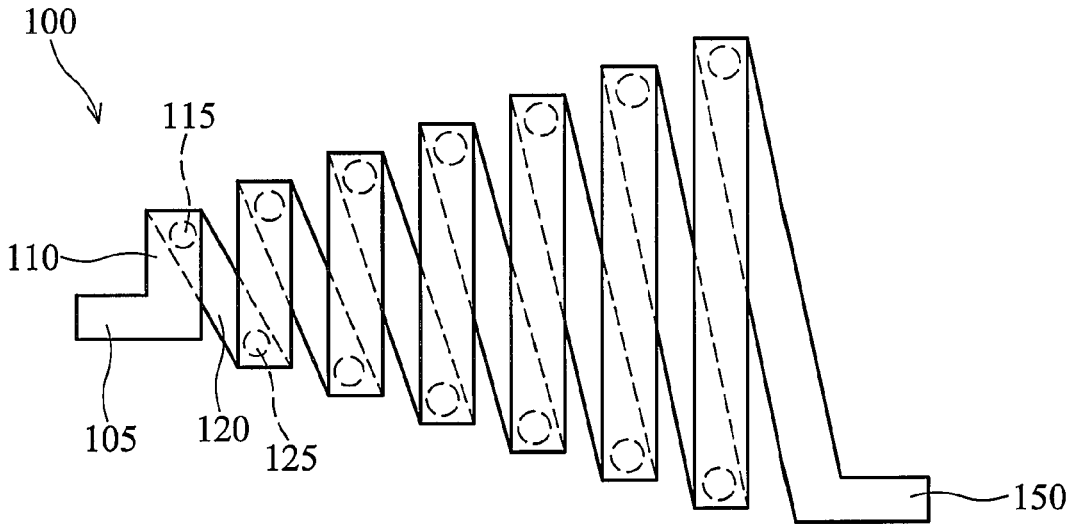
FIG. 3A is a schematic view of an exemplary embodiment of a homed shaped solenoid coil with gradually increased line length of the invention.

Referring to FIG. 3A, a horned shaped solenoid coil 100 with gradually increased line length comprises a plurality of windings surrounded. A winding comprises a first conductive segment 110 and a second conductive segment 120. A first conductive via hole 115 connects the first conductive segment 110 and the second conductive segment 120. A second conductive via hole 125 connects the second conductive segment 120 to a first conductive segment of the following winding. The horned shaped solenoid coil 100 further comprises an input end 105 and an output end 150. The input end 105 is connected to the first conductive segment 110 at the start of the windings. The output end 150 is connected to the second conductive segment at the end of the winding. The homed shaped solenoid coil 100 is gradually winded such that the length of the first conductive segment is lesser than that of the first conductive segment of the following winding.

Figure 3B:
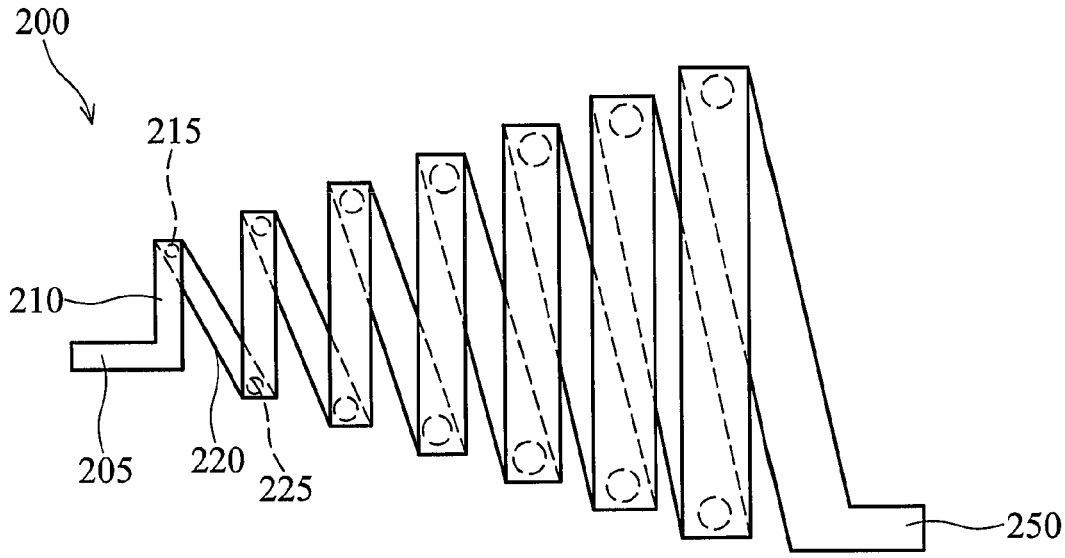
FIG. 3B is a schematic view of an exemplary embodiment of a homed shaped solenoid coil with gradually increased line length and width of the invention.

Referring to FIG. 3B, a horned shaped solenoid coil 200 with gradually increased line length and width comprises a plurality of windings surrounded. A winding comprises a first conductive segment 210 and a second conductive segment 220. A first conductive via hole 215 connects the first conductive segment 210 and the second conductive segment 220. A second conductive via hole 225 connects the second conductive segment 220 to a first conductive segment of the following winding. The homed shaped solenoid coil 200 further comprises an input end 205 and an output end 250. The input end 205 is connected to the first conductive segment 210 at the start of the windings. The output end 250 is connected to the second conductive segment at the end of the windings. The horned shaped solenoid coil 200 is gradually winded such that the length of the first conductive segment is lesser than that of the first conductive segment of the following winding, and the width of the first conductive segment is lesser than that of the first conductive segment of the following winding.

Figure 4:
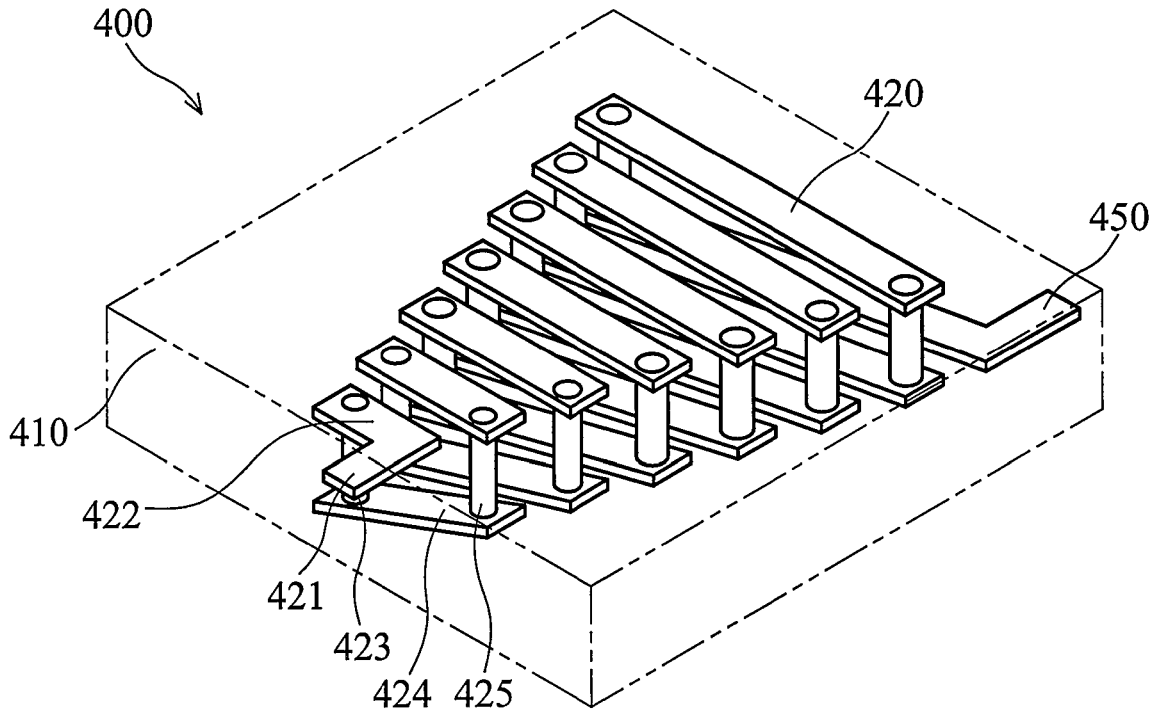
FIG. 4 is a schematic view of an exemplary embodiment of an embedded solenoid inductor device with gradually increased length of the invention.

Referring to FIG. 4, an embedded inductor device 400 comprises a substrate 410 and a gradual increased conductive coil 420 with a plurality of windings surrounded and disposed on the substrate 410. The substrate 410 comprises a polycarbonate board (PCB), a polymer substrate, ceramic substrate and magnetic substrate, preferably high-permeably material with relative permeability exceeding 1. A winding comprises a first conductive segment 422 disposed on a first surface of the substrate 410 and a second conductive segment 424 disposed on a second surface of the substrate 410. A first conductive via hole 423 perforating the substrate 410 connects the first conductive segment 422 and the second conductive segment 424. A second conductive via hole 425 perforating the substrate 410 connects the second conductive segment 424 to a first conductive segment of the following winding. The length of the first conductive segment 422 is lesser than that of the first conductive segment of the following winding. The gradual conductive coil 420 further comprises an input end 421 and an output end 450. The input end 421 is connected to the first conductive segment 422 at the start of the windings. The output end 450 is connected to the second conductive segment at the end of the windings. In the embodiment of the invention, the first conductive segments and the second conductive segments are straight line segments, and the length of the first conductive segment 422 is 1-3.5 times lesser than that of the following first conductive segment of the winding.

For example, when compared with a conventional embedded inductor device of the same length with the same inductance (e.g. 16.2 nH), the SRF of the gradually sized embedded inductor device increases from 3.1 GHz (conventional embedded inductor device) to 3.5 GHz, with an incremental ratio of about 13%. With the quality factor remaining virtually the same at 71, slightly down from 72 (conventional embedded inductor device).

Figure 5:
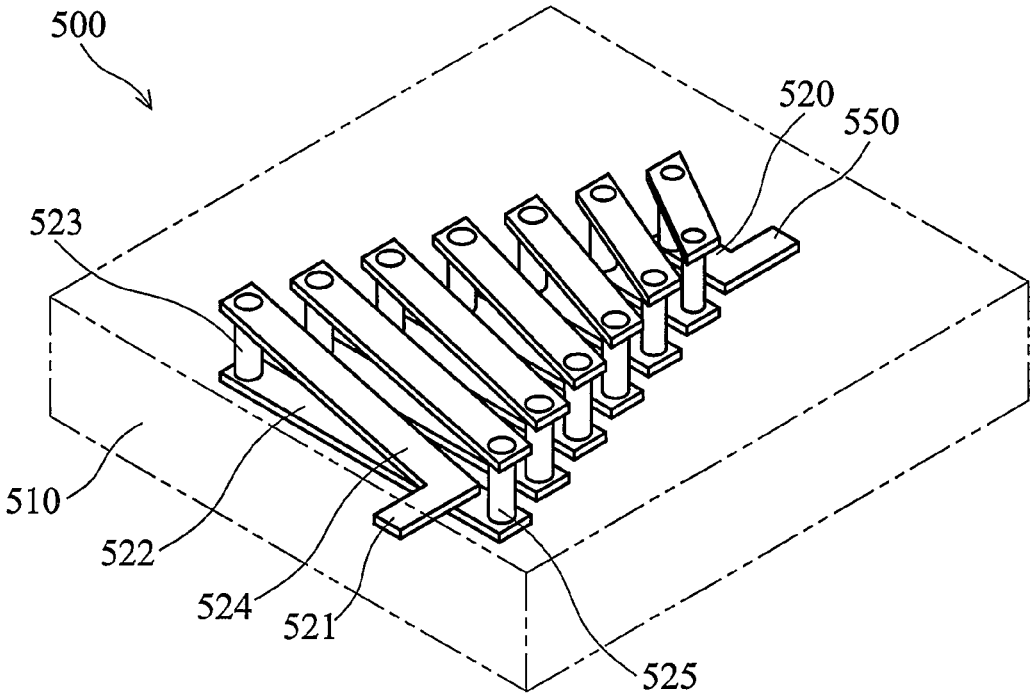
FIG. 5 is a schematic view of an exemplary embodiment of an embedded solenoid inductor device with gradually decreased length of the invention.

Referring to FIG. 5, an embedded inductor device 500 comprises a substrate 510 and a gradually decreased conductive coil 520 with a plurality of windings surrounded and disposed on the substrate 510. A winding comprises a first conductive segment 524 disposed on a first surface of the substrate 510. A second conductive segment 522 is disposed on a second surface of the substrate 510. A first conductive via hole 523 perforating the substrate 510 connects the first conductive segment 524 and the second conductive segment 522. A second conductive via hole 525 perforating the substrate 510 connects the second conductive segment 522 to a first conductive segment of the following winding. The length of the first conductive segment 524 is greater than that of the first conductive segment of the following winding. The gradual conductive coil 520 further comprises an input end 521 and an output end 550. The input end 521 is connected to the first conductive segment 524 at the start of the windings. The output end 550 is connected to the second conductive segment at the end of the windings.

For example, when a signal is input from the longest first conductive segment, inductance of the inductor device with gradually decreased length is 15.2 nH, the SRF is 3.4 GHz, and the quality factor is 72.

Figure 6:
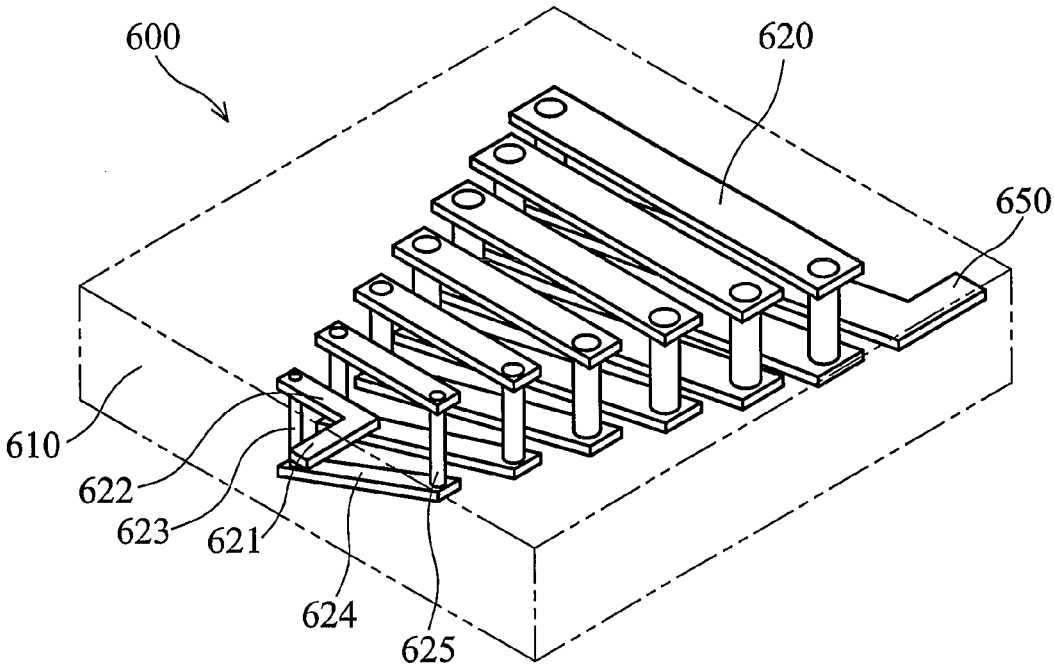
FIG. 6 is a schematic view of an exemplary embodiment of an embedded solenoid inductor device with gradually increased length and width of the invention.

Referring to FIG. 6, an embedded inductor device 600 comprises a substrate 610 and a gradual increased conductive coil 620 with a plurality of windings surrounded and disposed on the substrate 610. The substrate 610 comprises a polycarbonate board (PCB), a polymer substrate, ceramic substrate and magnetic substrate, preferably high-permeably material with relative permeability exceeding 1. A winding comprises a first conductive segment 622 disposed on a first surface of the substrate 610. A second conductive segment 624 disposed on a second surface of the substrate 610. A first conductive via hole 623 perforating the substrate 610 connects the first conductive segment 622 and second conductive segment 624. A second conductive via hole 625 perforating the substrate 610 connects the second conductive segment 624 to a first conductive segment of the following winding. The gradual increased conductive coil 620 further comprises an input end 621 and an output end 650. The input end 621 is connected to the first conductive segment 622 at the start of the windings. The output end 650 is connected to the second conductive segment at the end of the windings. In another embodiment of the invention, both the first conductive segment and the second conductive segment are straight line segments, and the width of the first conductive segment is 1-2.5 times lesser than that of the first conductive segment of the following winding. Furthermore, the diameter of the first conductive via hole is lesser than the diameter of the second conductive via hole.

Figure 7A:
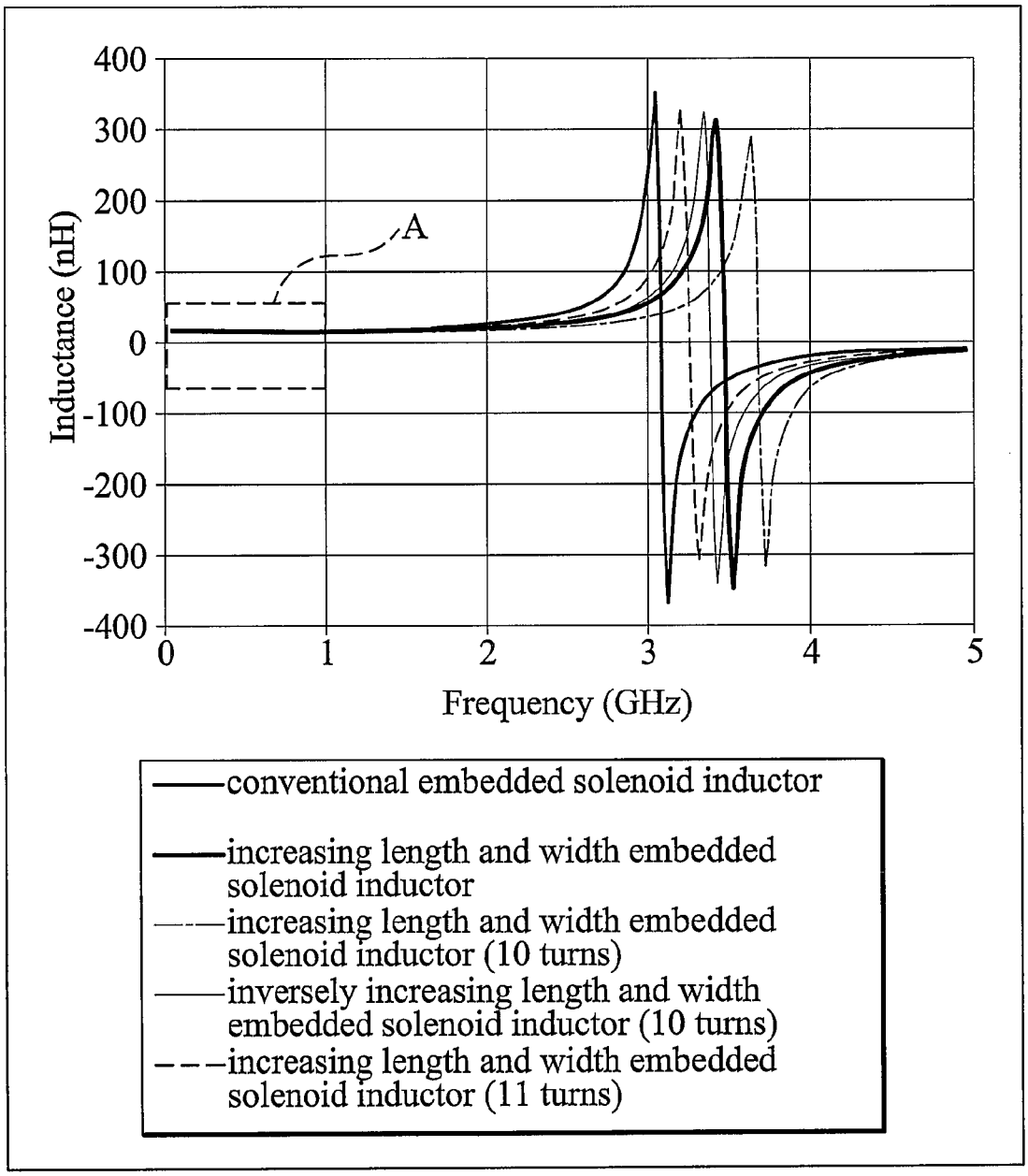
FIG. 7A shows inductance-frequency relationships among exemplary embodiments of embedded inductor devices of FIG. 3, FIG. 4, FIG. 5 and FIG. 6 compared with a conventional embedded inductor device as shown in FIG. 2.

Referring to FIG. 7A, when comparing the self-resonate frequency (SRF) of the embedded inductor devices shown in FIG. 2, FIG. 3, FIG. 4, FIG. 5 and FIG. 6, the conventional embedded inductor device has the lowest SRF, while the embedded solenoid inductor device with gradually increased length and width of 10 turns has the highest SRF.

Figure 7B:
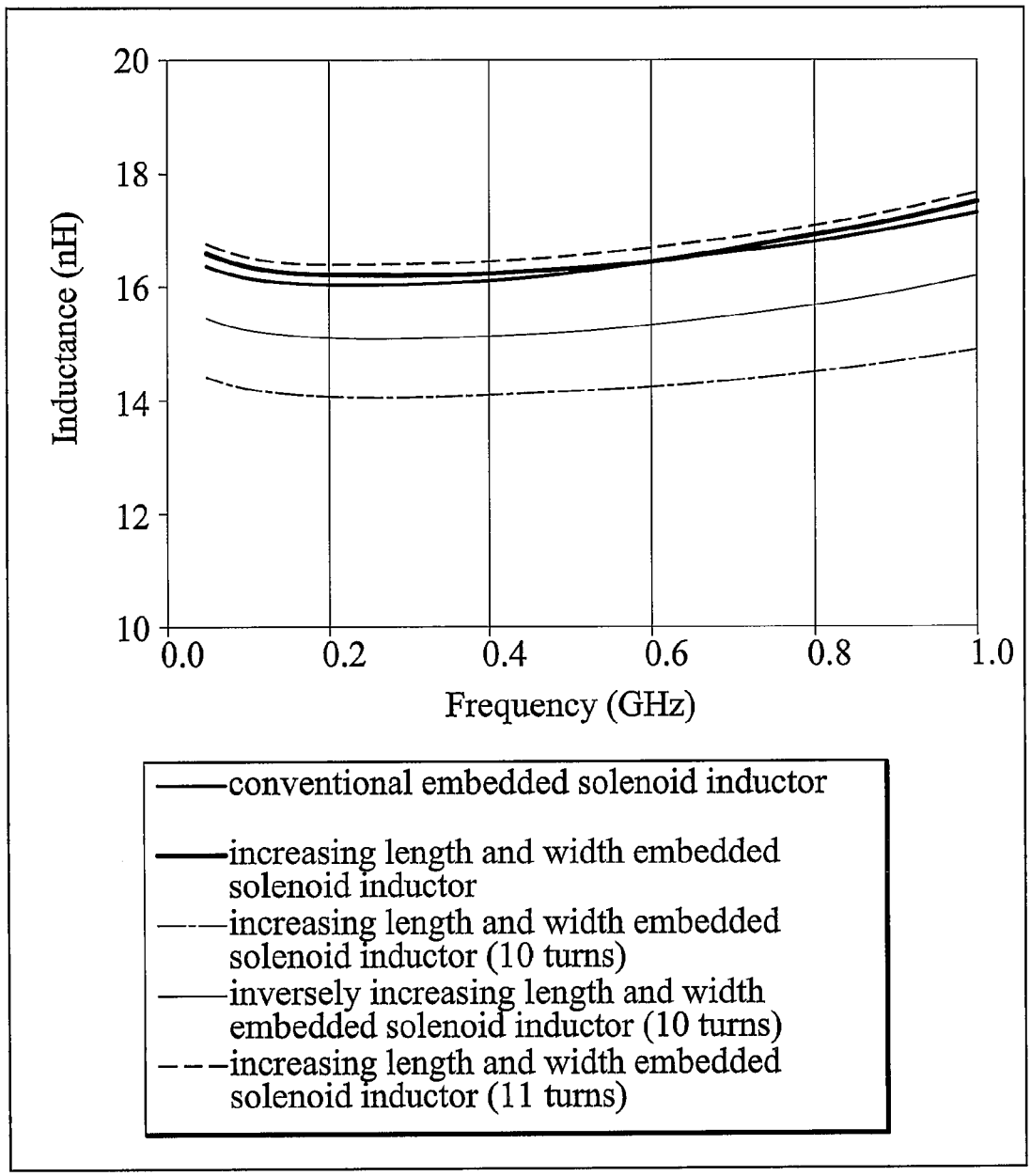
FIG. 7B shows a local enlargement (region A) of inductance-frequency relationships of FIG. 7A at low frequency range.

Referring to FIG. 7B when comparing the embedded inductor devices shown in FIG. 2, FIG. 3, FIG. 4, FIG. 5 and FIG. 6 at a low frequency range (0 to 1 GHz), the embedded solenoid inductor device with gradually increased length and width of 11 turns has the highest inductance at a low frequency range.

Figure 7C:
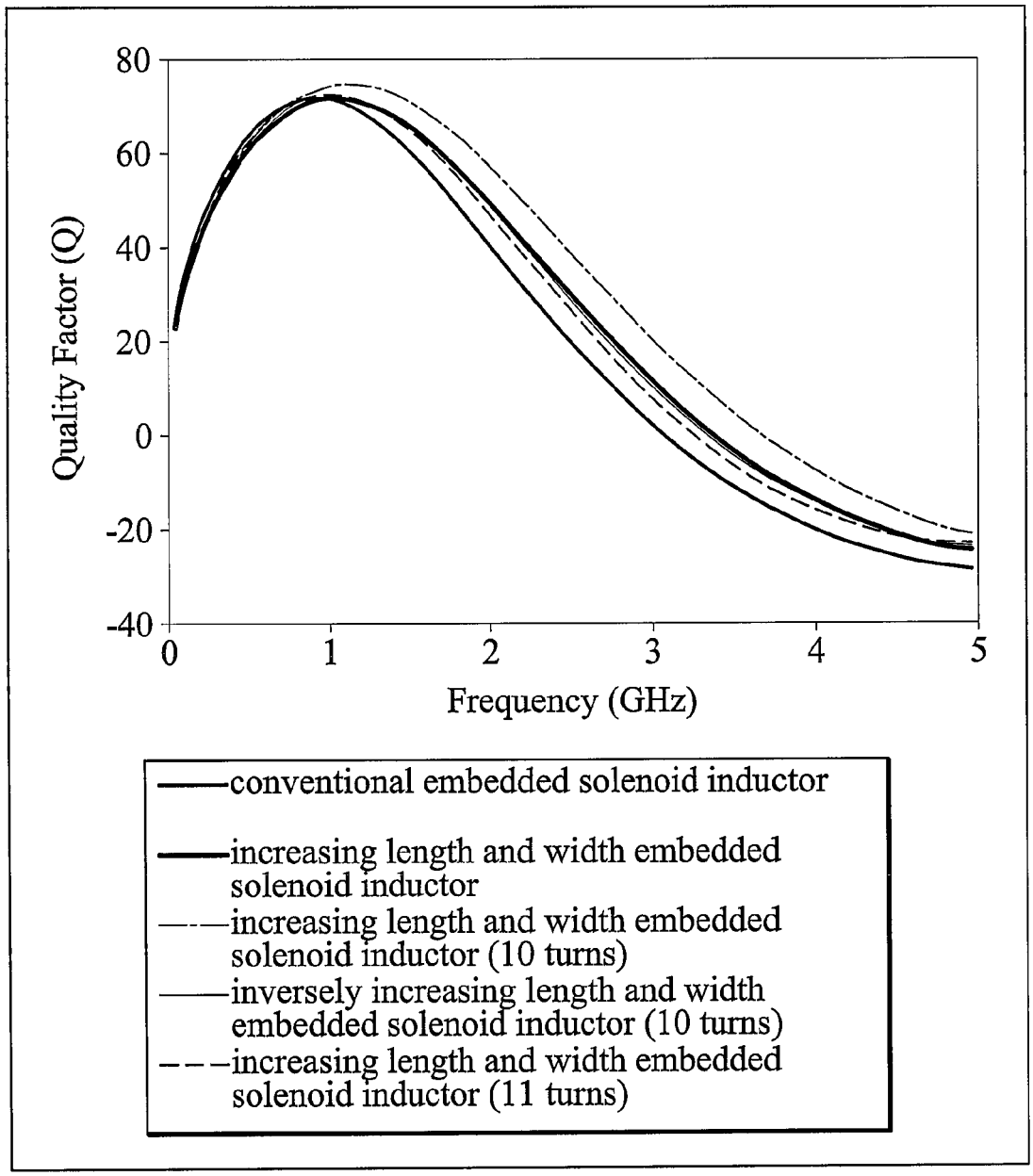
FIG. 7C shows quality factor-frequency relationships among exemplary embodiments of embedded inductor devices of FIG. 3, FIG. 4, FIG. 5, and FIG. 6 compared with a conventional embedded inductor device as shown in FIG. 2.

Referring to FIG. 7C, when comparing the embedded inductor devices shown in FIG. 2, FIG. 3, FIG. 4, FIG. 5 and FIG. 6, the embedded solenoid inductor device with gradually increased length and width of 10 turns has the highest quality factor.

Summarizing the example comparisons in FIG. 7A, FIG. 7B and FIG. 7C, if the embedded solenoid inductor device with gradually increased length is replaced by the embedded solenoid inductor device with gradually increased width, the inductance would slightly decrease from 16.2 nH to 14.2 nH, while the SRF would increase to 3.5 GHz, with an incremental ratio of about 21%. The quality factor would increase from 72 to 74.

Moreover, the number of turns of the gradual conductive coil should preferably exceed 10. Specifically, by increasing the turns of the embedded solenoid inductor device with gradually increased length and width to 11, the inductance should be 16.4 nH, the SRF should be 3.3 GHz, and the quality factor should be 73.

According to the examples of the embodiments of the invention, the thinner the solenoid conductive coil is, the higher the inductance of the embedded inductor device, but the lower the quality factor. The embedded solenoid inductor device with gradually increased length can improve SRF by more than 10%, while the embedded solenoid inductor device with gradually increased width can sufficiently improve quality factor. Thus, embedded solenoid inductor devices with gradually increased length and width can prevent magnetic hysteresis loss, providing higher self-resonate frequency and quality factor for high frequency application allowing for greater integration with other active and passive devices in the electronic circuit.

Figure 8A:
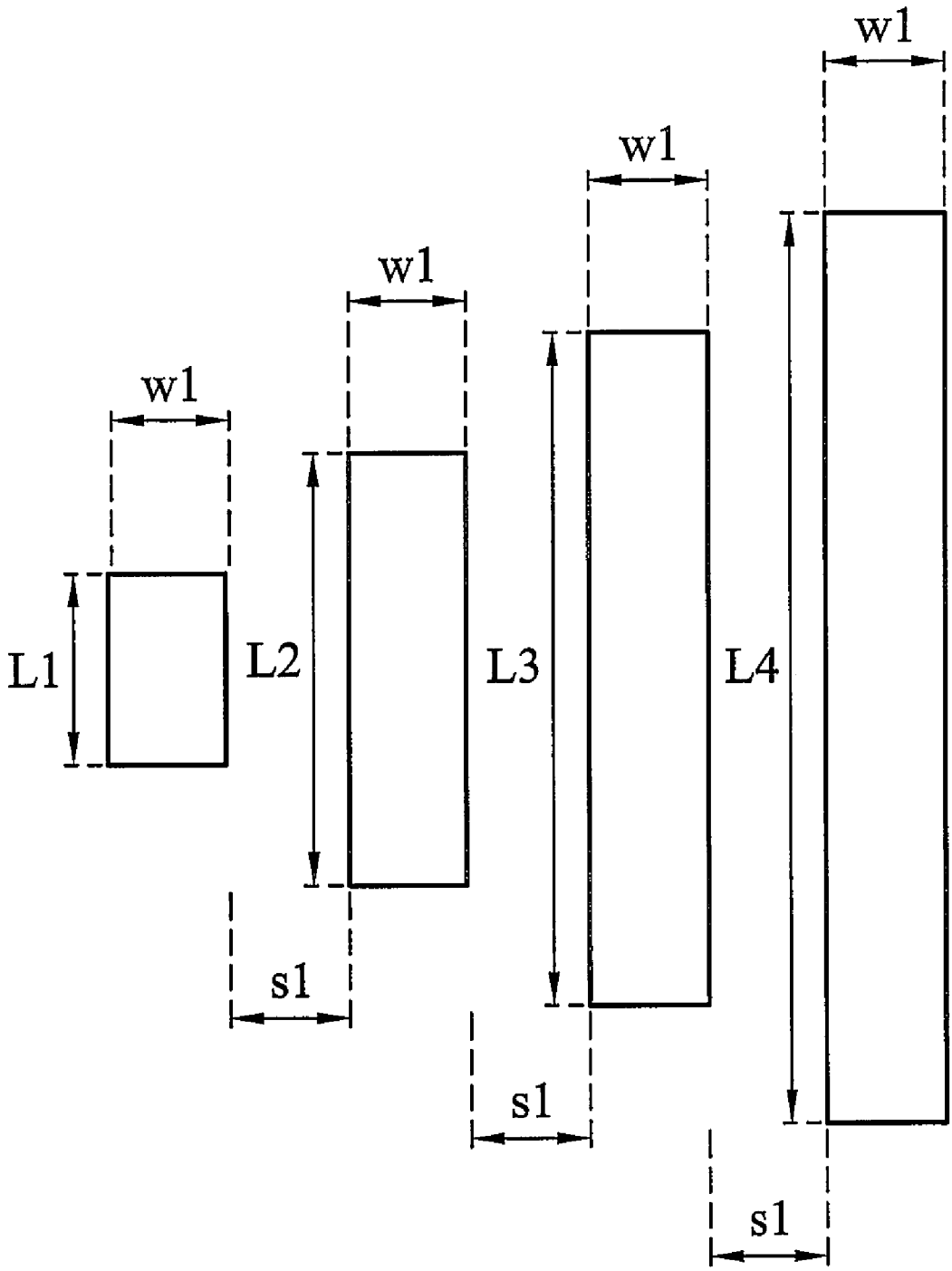
FIG. 8A, FIG. 8B, FIG. 8C and FIG. 8D are schematic views illustrating variations of line length, line width and line interval of an exemplary embodiment of the horn shaped solenoid coil.

Referring to FIG. 8A, the line width w1 and line interval s1 of the horn shaped solenoid coil are constant. The line lengths L1, L2, L3 and L4 of the horn shaped solenoid coil are gradually increased, wherein the length of the first conductive segment is 1-3.5 times lesser than that of the first conductive segment of the following winding.

Figure 8B:
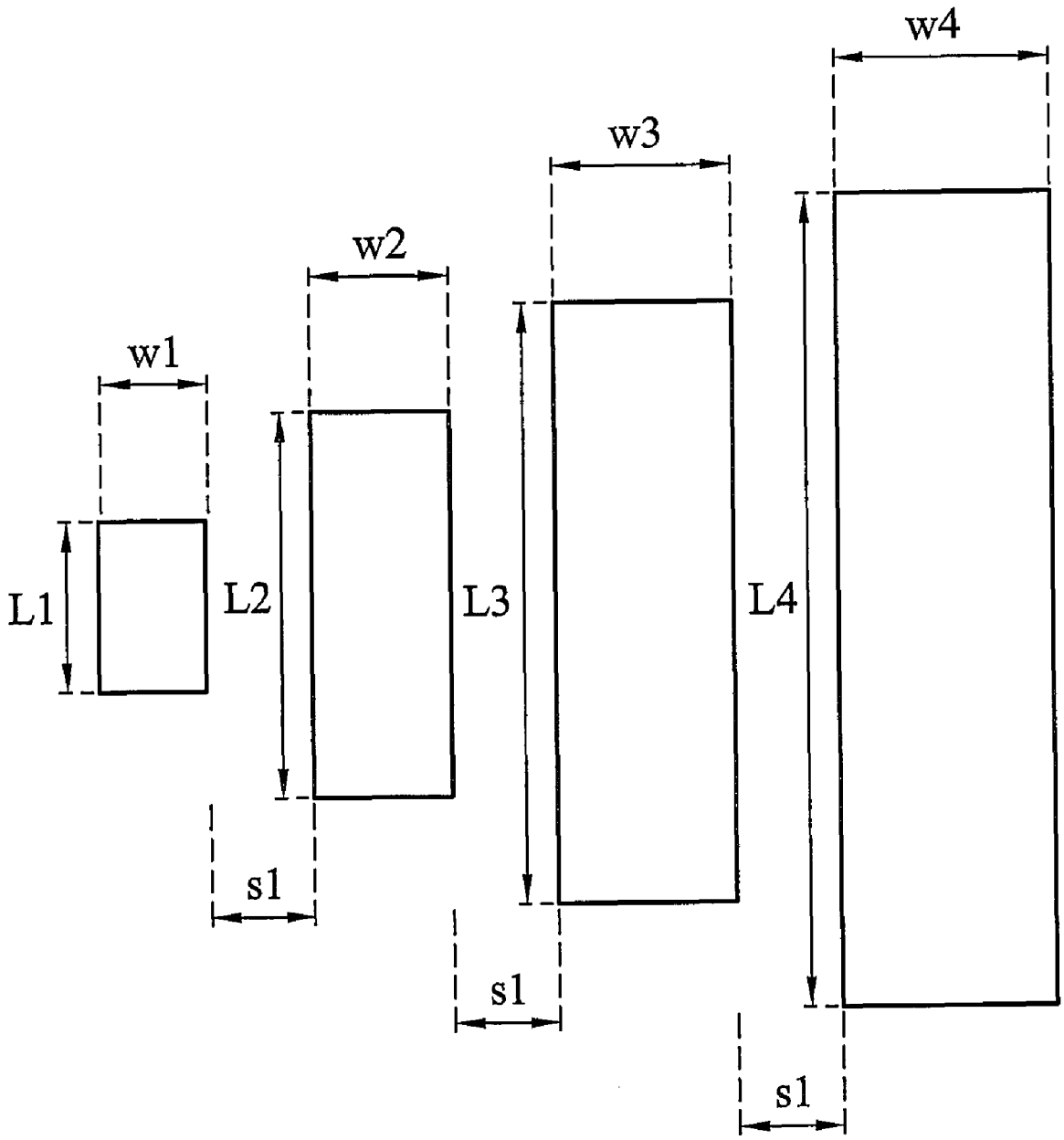

Referring to FIG. 8B, the line interval s1 of the horn shaped solenoid coil is constant. The line lengths L1, L2, L3 and L4 of the horn shaped solenoid coil are gradually increased, wherein the length of the first conductive segment is 1-3.5 times lesser than that of the first conductive segment of the following winding. The line widths w1, w2, w3 and w4 of the horn shaped solenoid coil are gradually increased, wherein the width of the first conductive segment is 1-2.5 times lesser than that of the first conductive segment of the following winding.

Figure 8C:
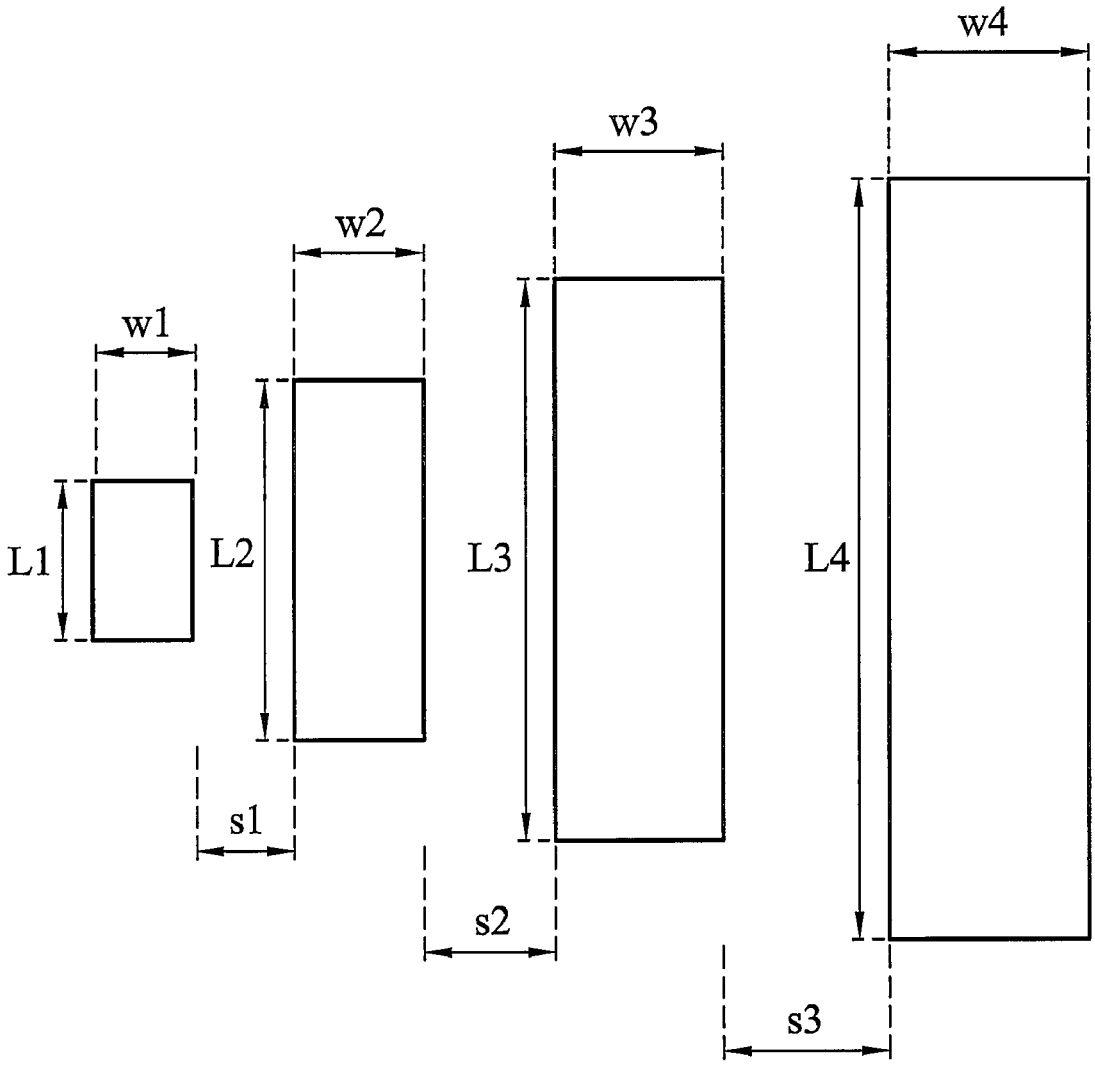

Referring to FIG. 8C, the line lengths L1, L2, L3 and L4 of the horn shaped solenoid coil are gradually increased, wherein the length of the first conductive segment is 1 is 3.5 times lesser than that of the first conductive segment of the following winding. The line widths w1, w2, w3 and w4 of the horn shaped solenoid coil are gradually increased, wherein the width of the first conductive segment is 1-2.5 times lesser than that of the first conductive segment of the following winding. The line intervals s1, s2, s3 and s4 of the horn shaped solenoid coil are gradually increased, wherein the distance between the first conductive segment and previous first conductive segment is 1-2 times lesser than the distance between the first conductive segment and following conductive segment.

Figure 8D:
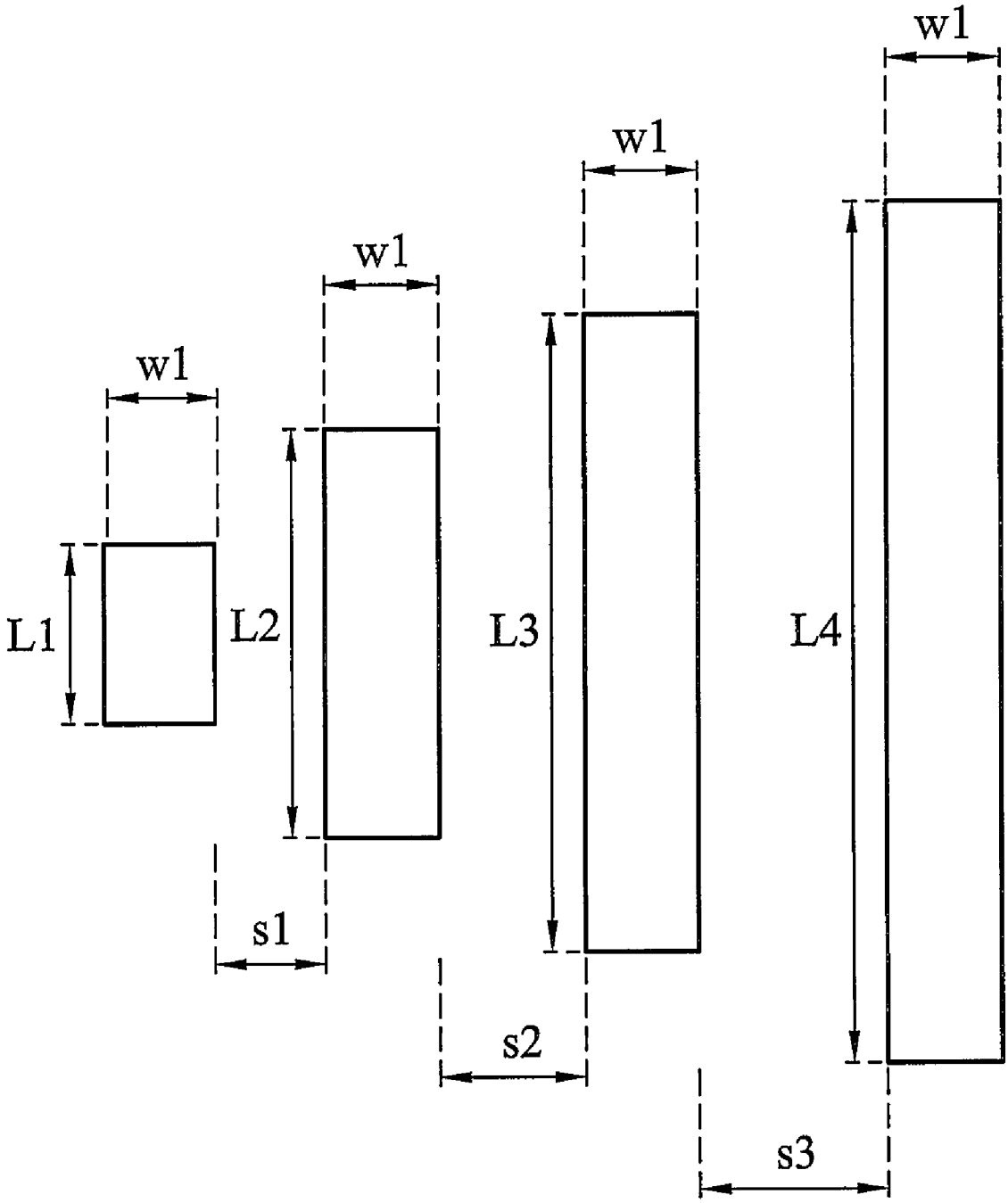

Referring to FIG. 8D, the line width w1 of the horn shaped solenoid coil is constant. The line lengths L1, L2, L3 and L4 of the horn shaped solenoid coil are gradually increased, wherein the length of the first conductive segment is 1-3.5 times lesser than that of the first conductive segment of the following winding. The line intervals s1, s2, s3 and s4 of the horn shaped solenoid coil are gradually increased, wherein the distance between the first conductive segments and previous first conductive segment is 1-2 times lesser than the distance between the first conductive segment and the following conductive segment.

Figure 9A:
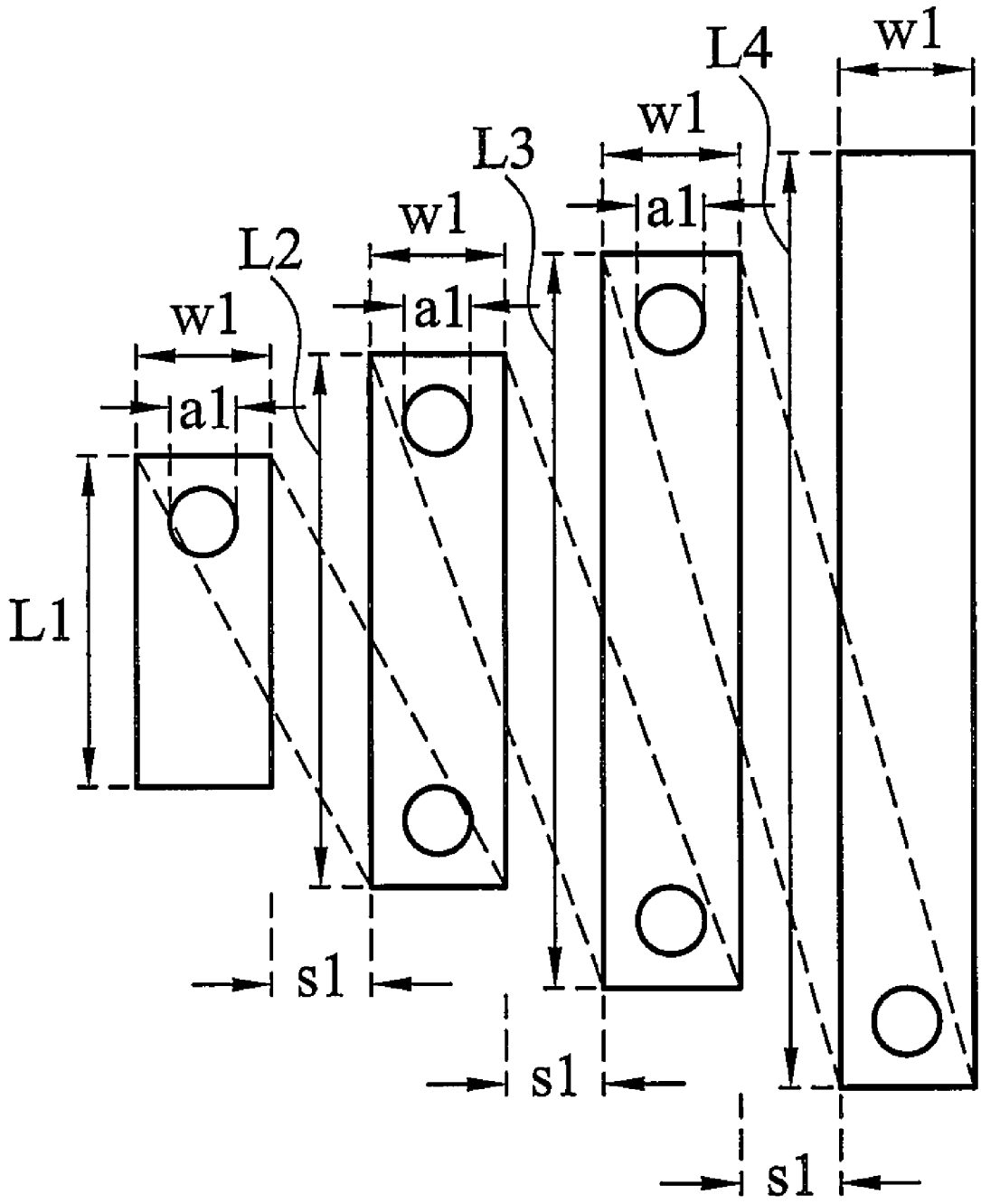
FIG. 9A, FIG. 9B, FIG. 9C, FIG. 9D and FIG. 9E are schematic views illustrating variations of line length, line width and line interval, via hole diameter of an exemplary embodiment of the horn shaped solenoid coil.

Referring to FIG. 9A, the line lengths L1, L2, L3 and L4 of the horn shaped solenoid coil are gradually increased, while the line width w1, line interval s1 and the conductive via hole diameter a1 of the horn shaped solenoid coil are constant.

Figure 9B:
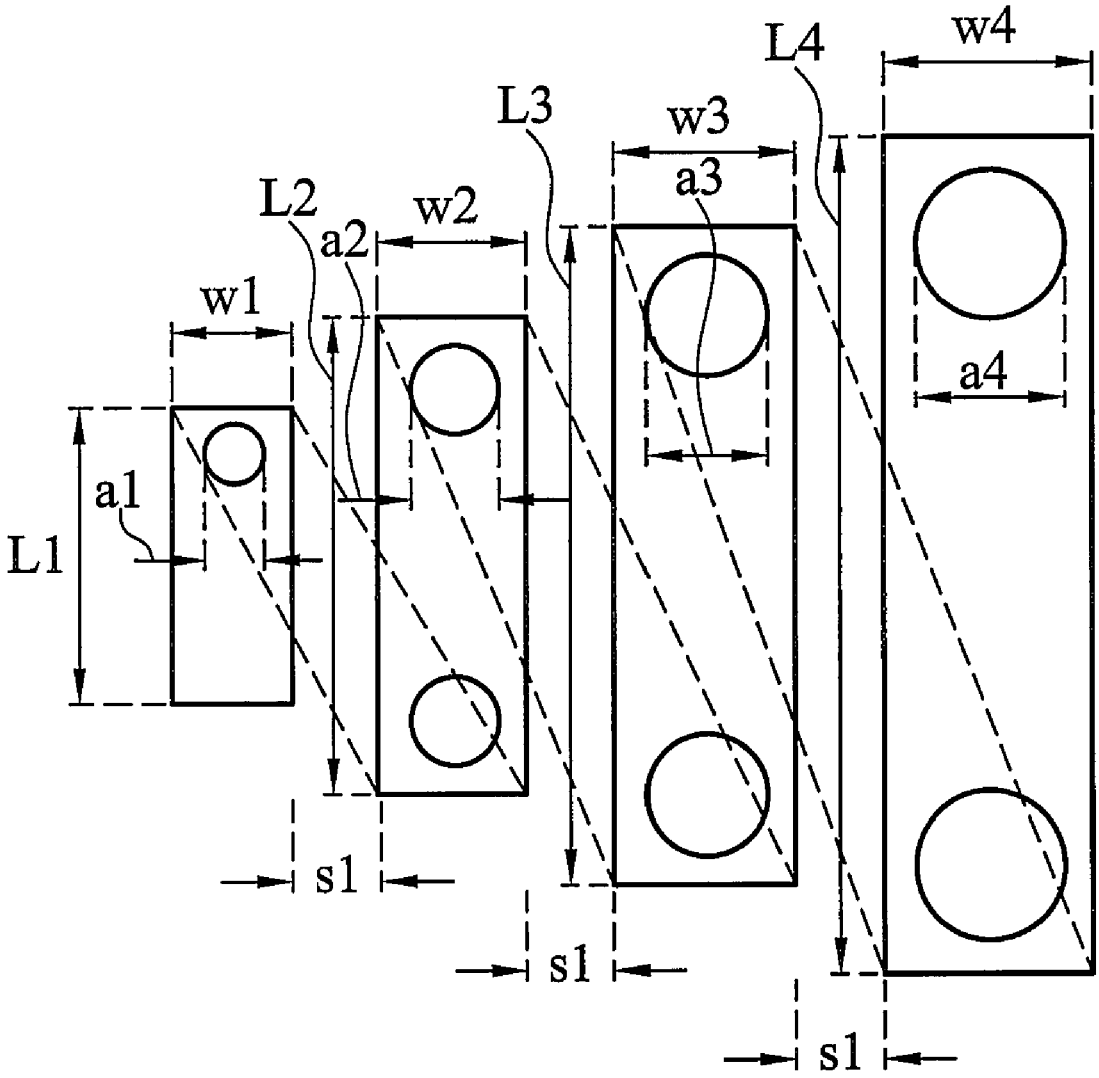

Referring to FIG. 9B, the line lengths L1, L2, L3 and L4 and the line widths w1, w2, w3 and w4 of the horn shaped solenoid coil are gradually increased, while the line interval s1 of the horn shaped solenoid coil is constant. The conductive via hole diameter a1, a2, a3 and a4 of the horn shaped solenoid coil are gradually increased, wherein the diameter of the first conductive via hole is 1-2 times lesser than that of the first conductive via hole of the following winding.

Figure 9C:
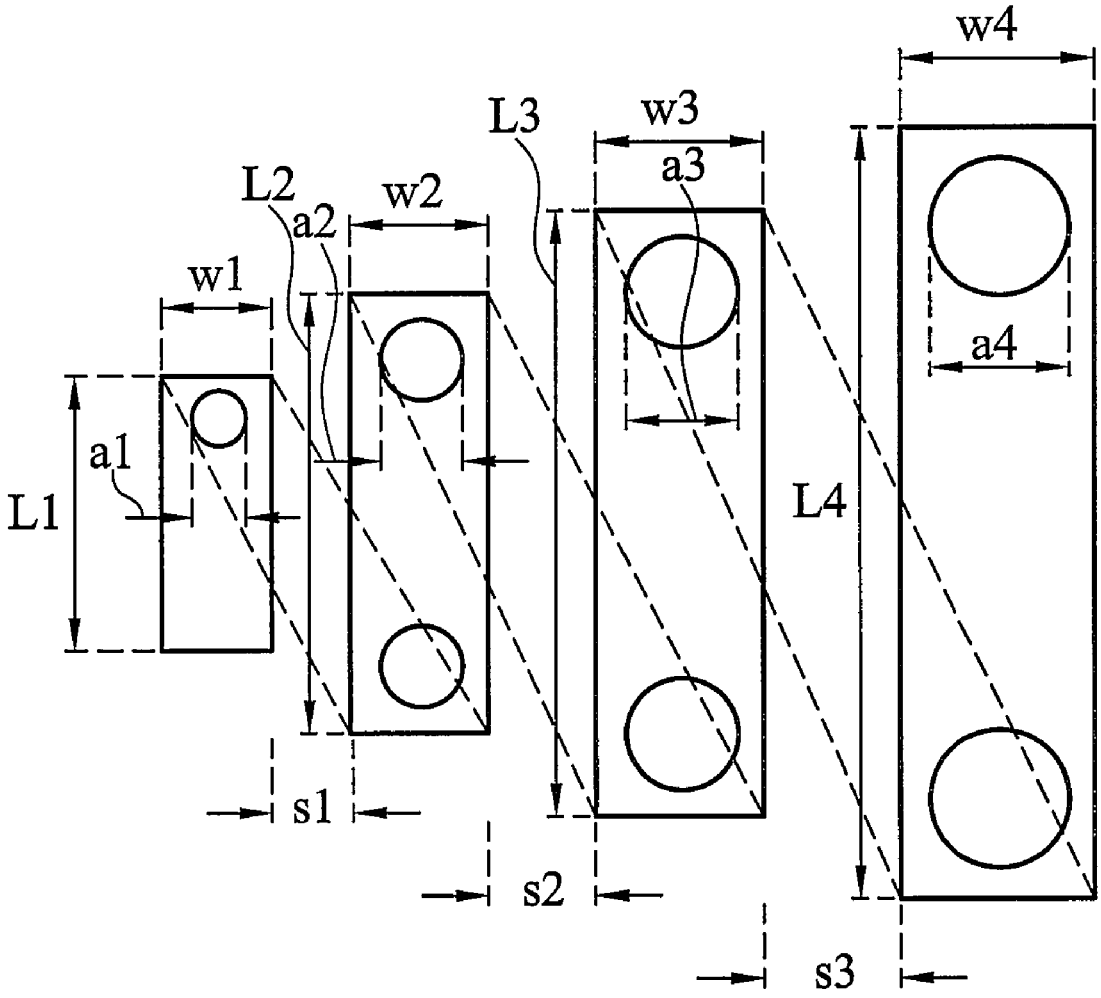

Referring to FIG. 9C, the line lengths L1, L2, L3 and L4, the line widths w1, w2, w3 and w4, and the line interval s1, s2, s3 of the horn shaped solenoid coil are gradually increased. The conductive via hole diameters a1, a2, a3 and a4 of the horn shaped solenoid coil are also gradually increased, wherein the diameter of the first conductive via hole is 1-2 times lesser than that of the first conductive via hole of the following winding.

Figure 9D:
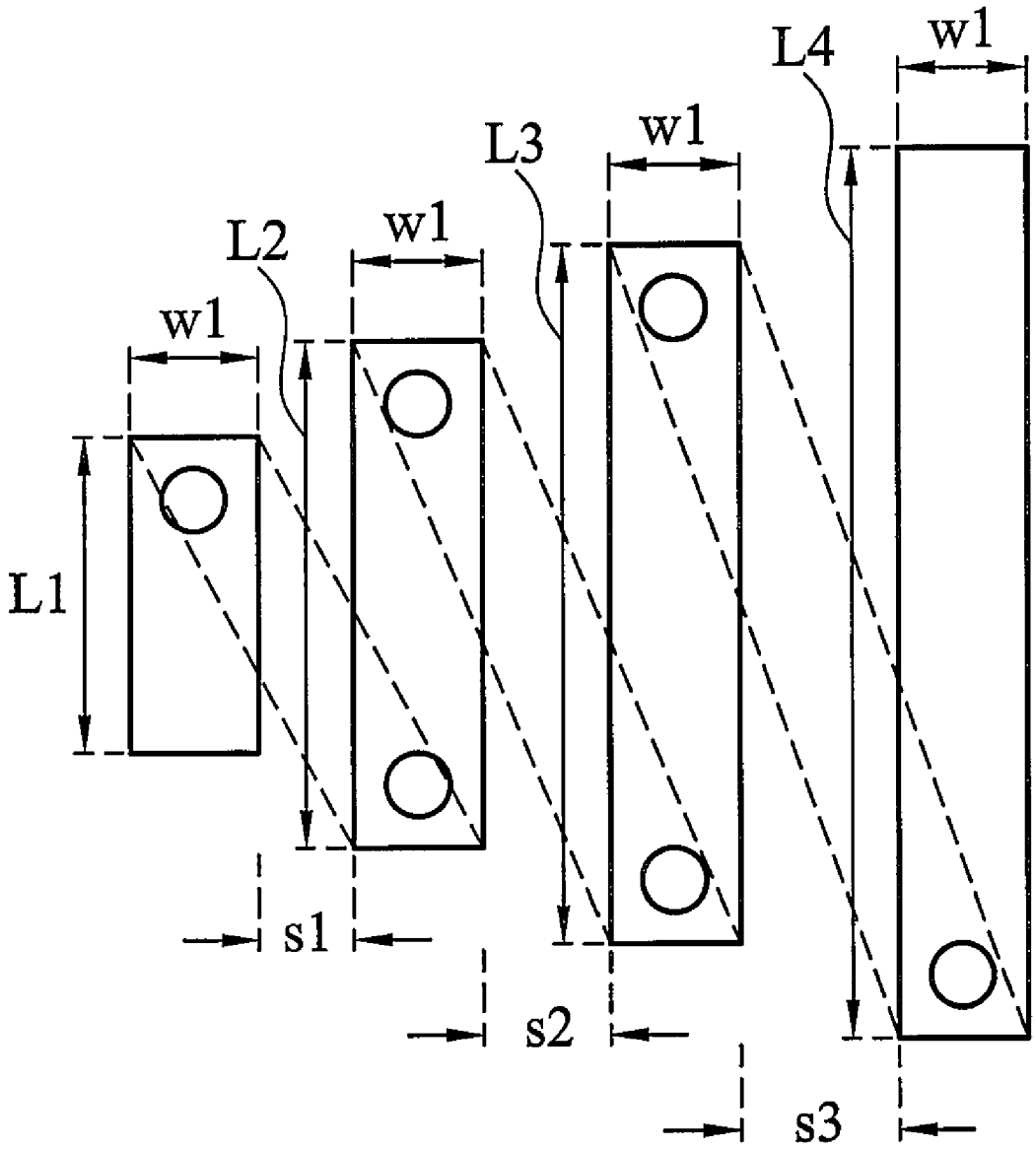
Figure 9E:
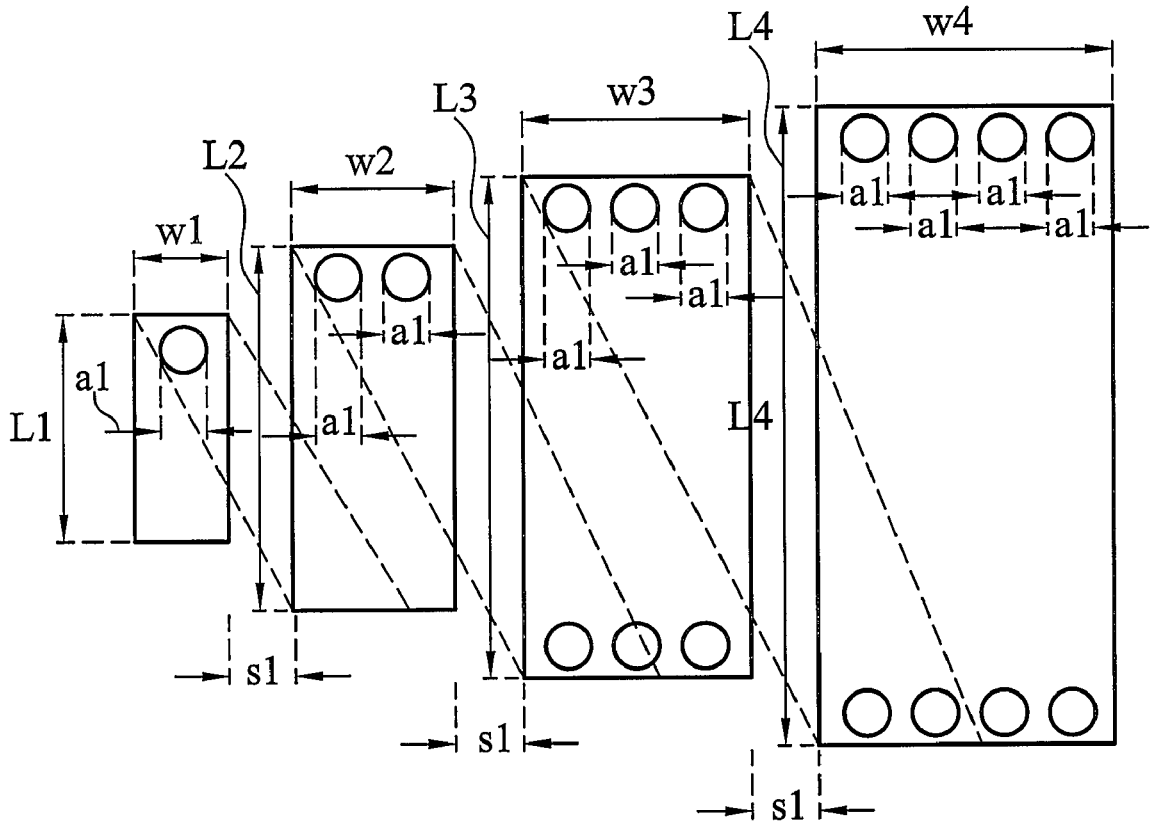

Referring to FIG. 9D, the line lengths L1, L2, L3 and L4 and the line interval s1, s2 and s3 of the horn shaped solenoid coil are gradually increased, while the line width w1 and conductive via hole diameter (as shown in FIG. 9D) of the horn shaped solenoid coil are constant. Referring to FIG. 9E, in the exemplary embodiment the line lengths L1, L2, L3 and L4, the line widths w1, w2, w3 and w4, and the line interval s1 of the horn shaped solenoid coil are gradually increased, while the conductive via hole diameter a1 of the horn shaped solenoid coil is constant. The amount of the conductive via holes increase along with the increase in width of the conductive segments.

Figure 10:
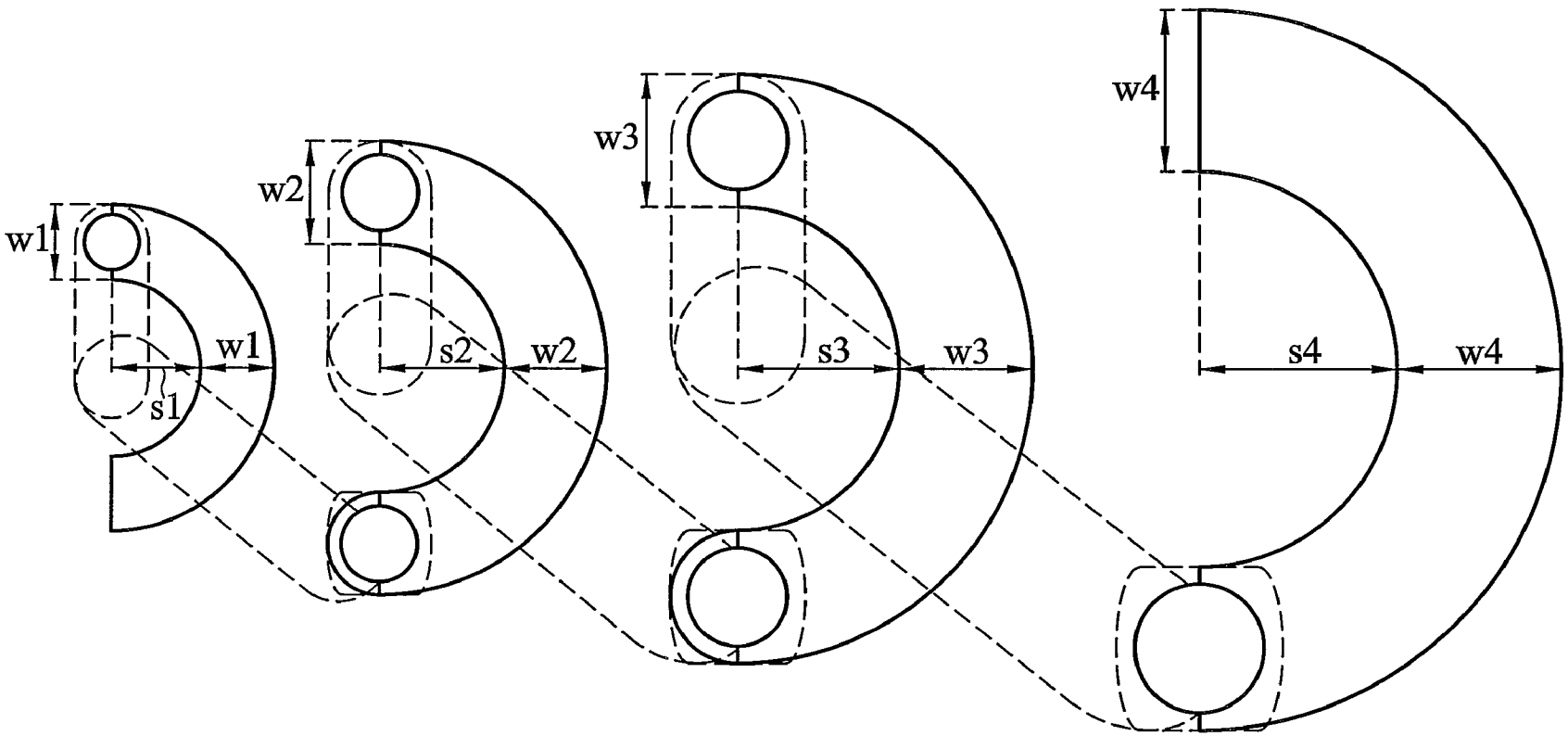
FIG. 10 is a schematic view of an exemplary embodiment of the horned shaped solenoid coil with gradual variation of line length and width of the invention.

Referring to FIG. 10, the conductive segments of the horned shaped solenoid coil are not limited to straight lines, other geometric shapes, such as arcs and semi-arcs are applicable thereto. The line lengths L1, L2, L3 and L4 and the line intervals s1, s2, s3 and s4 of the horn shaped solenoid coil can be gradually increased or remained constant. The line widths w1, w2, w3 and w4 and the conductive via hole diameters a1, a2, a3 and a4 of the horn shaped solenoid coil can be gradually increased or remained constant.

Figure 11:
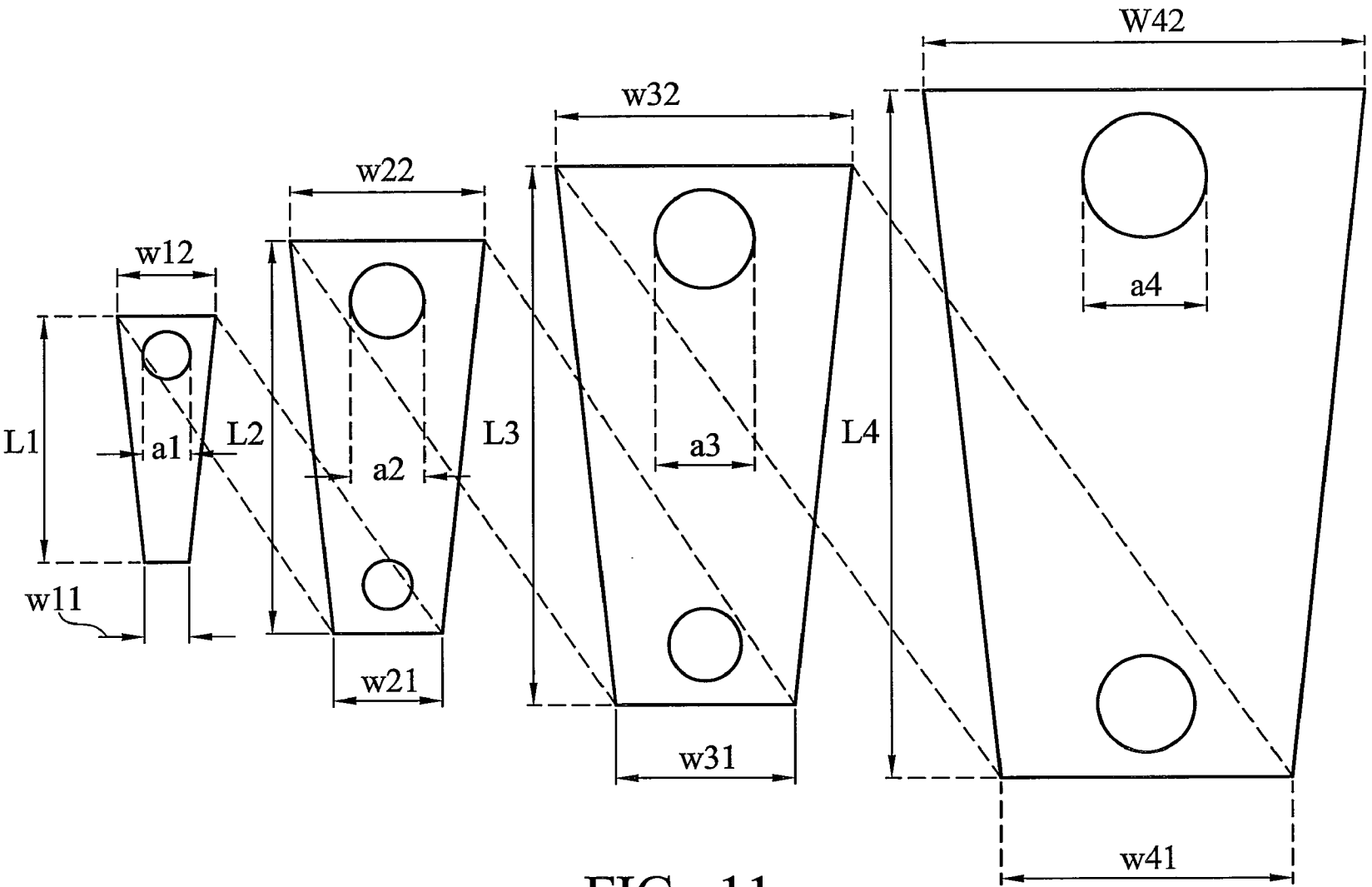
FIG. 11 is a schematic view of another exemplary embodiment of the horned shaped solenoid coil with gradual variation of line length and width of the invention.

FIG. 11 is a schematic view of another exemplary embodiment of the horned shaped solenoid coil with gradually increased line length and width of the invention. The conductive segments of the horned shaped solenoid coil are trapezoid line segments. Specifically, the width of one end of the conductive segment (e.g., w21) is less than the width of the corresponding opposite end of the conductive segment (e.g., w22).

Figure 12A:
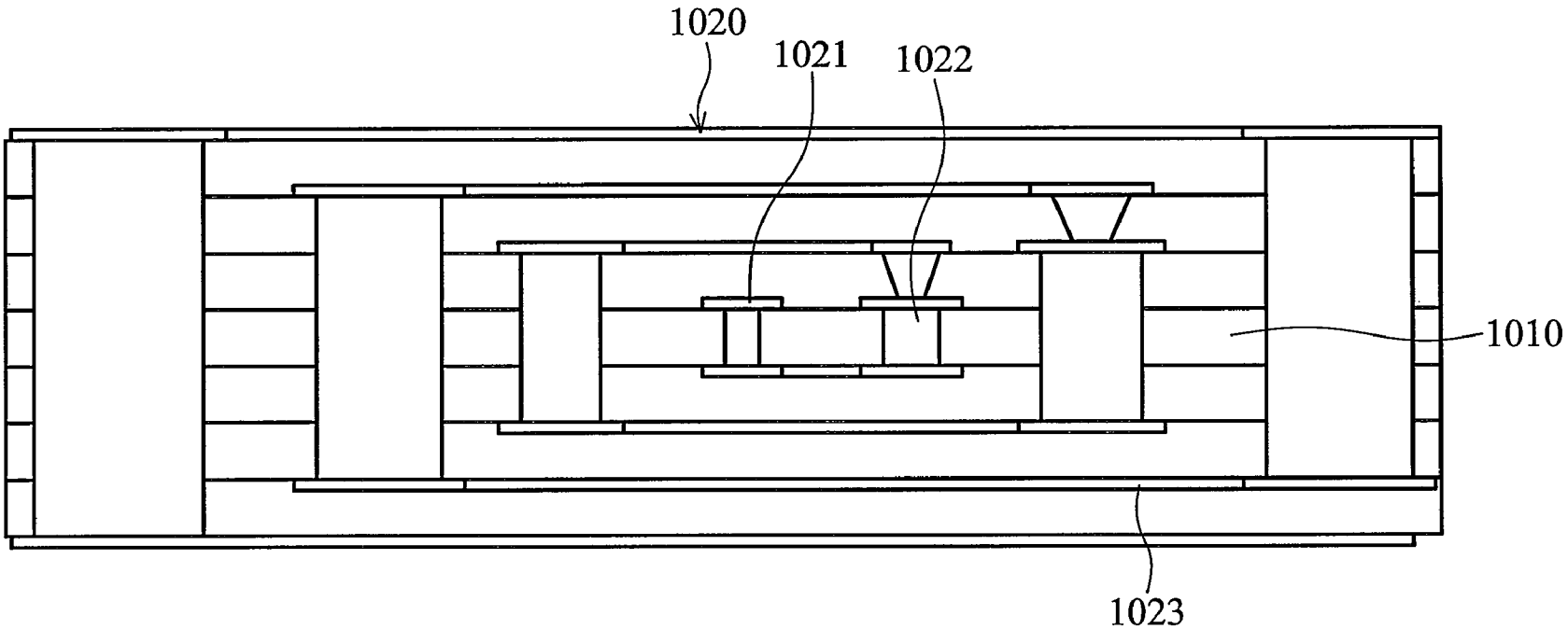
FIG. 12A is a schematic view of another exemplary embodiment of the horned shaped solenoid coil in a multi-layer laminated substrate of the invention and FIG. 12B shows variations of the conductive via holes 1022*a*, 1022*b*, 1022*c*, 1022*d*, 1022*e*, 1022*f*, 1022*g*, 1022*h*, 1022*i* and 1022*j*, separately disposed in a multi-layer laminated substrate of the invention.
Figure 12B:
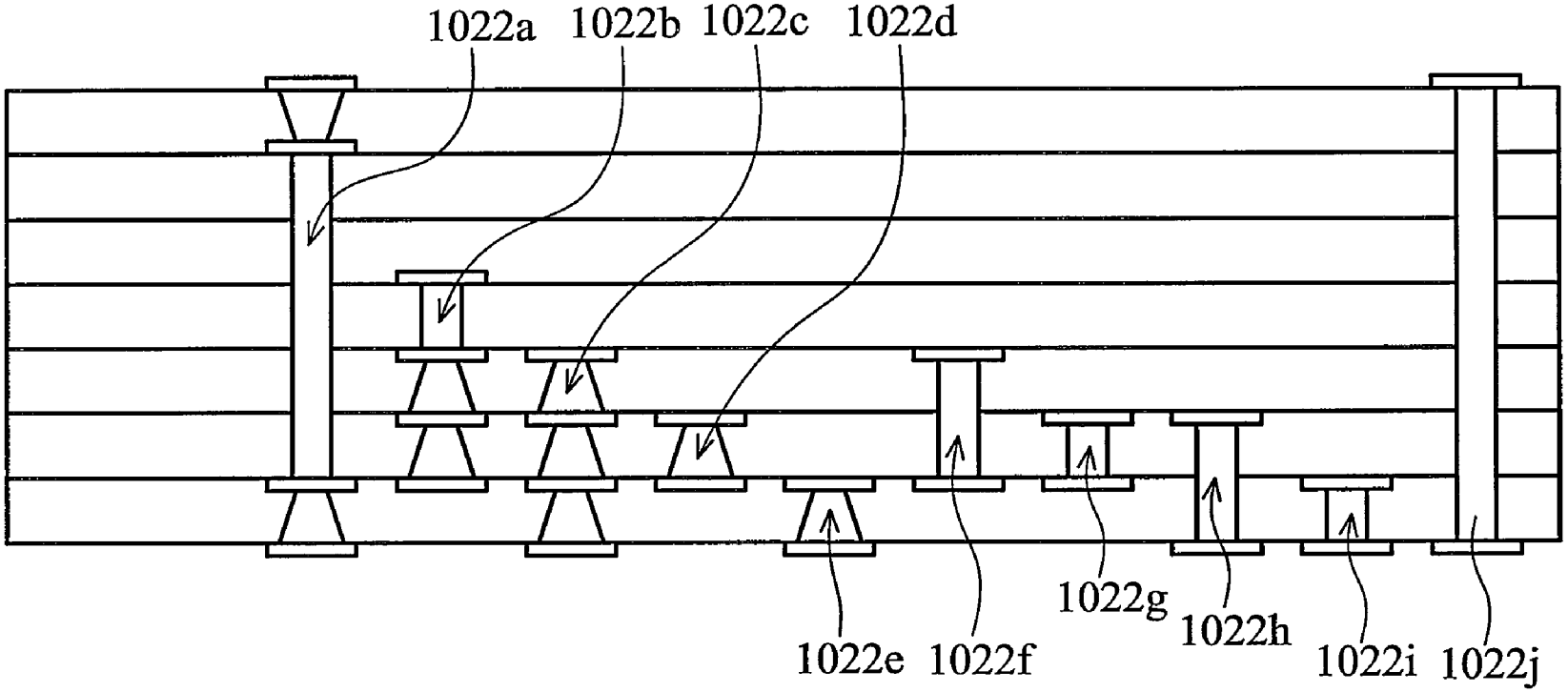

Note that the embedded solenoid inductor devices with gradually increased length and width of the invention are not limited to being disposed on a single layer substrate. Multi-layer laminated substrates are also applicable thereto. For example, referring to FIG. 12A, a conductive coil 1020 is wound outwardly from central layer 1010 of a multi-layer laminated substrate. The conductive coil 1020 is initiated from an input end 1021 through a conductive via hole 1022 and a conductive segment 1023, wherein the line length, line width, line interval and conductive via hole diameter can be gradually increased or remained constant. The shape of the first conductive via hole comprises a straight column, a trapezoid, or combinations thereof. For example, referring to FIG. 12B, variations of the conductive via holes 1022*a*, 1022*b*, 1022*c*, 1022*d*, 1022*e*, 1022*f*, 1022*g*, 1022*h*, 1022*i* and 1022*j* are separately disposed in a multi-layer laminated substrate. Each of the conductive via holes 1022*a*, 1022*b*, 1022*c*, 1022*d*, 1022*e*, 1022*f*, 1022*g*, 1022*h*, 1022*i* and 1022*j* can be formed by laser drilling, mechanic drilling, or laser and mechanic hybrid drilling. The conductive via holes 1022*a*, 1022*b*, 1022*c*, 1022*d*, 1022*e*, 1022*f*, 1022*g*, 1022*h*, 1022*i* and 1022*j* comprise a through via hole, a blind via hole and a buried via hole or other.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inductor device, comprising:

a substrate; and a gradually sized conductive coil with a plurality of windings surrounding a part of the substrate;

wherein each of the windings comprises a first conductive segment, a second conductive segment, a first conductive via hole connecting the first and second conductive segments, and a second conductive via hole connecting the second conductive segment to a first conductive segment of a following winding; and wherein the length of the first conductive segment is 1-3.5 times less than that of the first conductive segment of the following winding.

2. The inductor device as claimed in claim 1, wherein the substrate comprises a high magnetic permeable material with relative permeability substantially greater than 1.

3. The inductor device as claimed in claim 1, further comprising an input end connected to the shortest first conductive segment, and an output end connected to the longest second conductive segment.

4. The inductor device as claimed in claim 1, further comprising an input end connected to the longest first conductive segment, and an output end connecting the shortest second conductive segment.

5. The inductor device as claimed in claim 1, wherein the width of the first conductive segment is less than that of the first conductive segment of the following winding.

6. The inductor device as claimed in claim 1, wherein the width of the first conductive segment is less than that of the second conductive segment.

7. The inductor device as claimed in claim 1, wherein the distance between the first conductive segment and the previous first conductive segment is less than the distance between the first conductive segment and the following first conductive segment.

8. The inductor device as claimed in claim 1, wherein the distance between the first conductive segments and the previous first conductive segment is 1-2 times greater than the distance between the first conductive segment and the following first conductive segment.

9. The inductor device as claimed in claim 1, wherein the diameter of the first conductive via hole is less than the diameter of the second conductive via hole.

10. The inductor device as claimed in claim 1, wherein the diameter of the first conductive via hole is less than that of the first conductive via hole of the following winding.

11. The inductor device as claimed in claim 1, wherein the diameter of the first conductive via hole is 1-2 times greater than that of the first conductive via hole of the following winding.

12. The inductor device as claimed in claim 1, wherein the shape of the first conductive via hole comprises a straight column, a trapezoid, or combinations thereof.

13. The inductor device as claimed in claim 1, wherein both the first conductive segment and the second conductive segment are straight line segments.

14. The inductor device as claimed in claim 1, wherein both the first conductive segment and the second conductive segment are trapezoid line segments.

15. The inductor device as claimed in claim 1, wherein both the first conductive segment and the second conductive segment are semi-arc segments.

16. The inductor device as claimed in claim 1, wherein the width of the first conductive segment is 1-2.5 times greater than that of the first conductive segment of the following winding.

17. The inductor device as claimed in claim 1, wherein the substrate is a multi-layer laminated substrate structure.

18. The inductor device as claimed in claim 1, wherein the length and width and line interval of the inductor device are gradually increased, and the diameter of each conductive via hole is constant, with more than one conductive via hole disposed at the conductive segment.

19. An inductor device, comprising:

a substrate; and a gradually sized conductive coil with a plurality of windings surrounding a part of the substrate;

wherein each of the windings comprises a first conductive segment, a second conductive segment, a first conductive via hole connecting the first and second conductive segments, and a second conductive via hole connecting the second conductive segment to a first conductive segment of a following winding; and wherein the length of the first conductive segment of a winding is 1-3.5 times less than that of the first conductive segment of the following winding, and the width of the first conductive segment is less than that of the first conductive segment of the following winding.

20. The inductor device as claimed in claim 19, wherein the substrate comprises a high magnetic permeable material with relative permeability substantially greater than 1.

21. The inductor device as claimed in claim 19, further comprising an input end connected to the shortest first conductive segment, and an output end connected to the longest second conductive segment.

22. The inductor device as claimed in claim 19, further comprising an input end connected to the longest first conductive segment, and an output end connected to the shortest second conductive segment.

23. The inductor device as claimed in claim 19, wherein the distance between the first conductive segments and the previous first conductive segment is lesser than the distance between the first conductive segment and the following first conductive segment.

24. The inductor device as claimed in claim 19, wherein the distance between the first conductive segment and the previous first conductive segment is 1-2 times greater than the distance between the first conductive segment and the following first conductive segment.

25. The inductor device as claimed in claim 19, wherein the diameter of the first conductive via hole is less than the diameter of the second conductive via hole.

26. The inductor device as claimed in claim 19, wherein the diameter of the first conductive via hole is less than that of the first conductive via hole of the following winding.

27. The inductor device as claimed in claim 19, wherein the diameter of the first conductive via hole is 1-2 times greater than that of the first conductive via hole of the following winding.

28. The inductor device as claimed in claim 19, wherein the shape of the first conductive via hole comprises a straight column, a trapezoid, or combinations thereof.

29. The inductor device as claimed in claim 19, wherein both the first conductive segment and the second conductive segment are straight line segments.

30. The inductor device as claimed in claim 19, wherein both the first conductive segment and the second conductive segment are trapezoid line segments.

31. The inductor device as claimed in claim 19, wherein both the first conductive segment and the second conductive segment are semi-arc segments.

32. The inductor device as claimed in claim 19, wherein the width of the first conductive segment is 1-2.5 times greater than that of the first conductive segment of the following winding.

33. The inductor device as claimed in claim 19, wherein the substrate is a multi-layer laminated substrate structure.

34. The inductor device as claimed in claim 19, wherein the number of windings of the gradually sized conductive coil exceeds 10.

35. The inductor device as claimed in claim 19, wherein the length and width and line interval of the inductor device are gradually increased, and the diameter of each conductive via hole is constant, with more than one conductive via hole disposed at the conductive segment.

* * * * *